US005229580A

United States Patent [19]

Chioniere

[11] Patent Number: 5,229,580

[45] Date of Patent: Jul. 20, 1993

[54] BLOCK FOR HOLDING MULTIPLE SAMPLE TUBES FOR AUTOMATIC TEMPERATURE CONTROL

[75] Inventor: Michael J. Chioniere, Essex, Mass.

[73] Assignee: Automated Biosystems, Inc., Essex, Mass.

[21] Appl. No.: 895,943

[22] Filed: Jun. 9, 1992

[51] Int. Cl.[5] ..... H05B 3/02

[52] U.S. Cl. ..... 219/521; 219/386

[58] Field of Search ..... 219/521, 385, 386

[56] References Cited

U.S. PATENT DOCUMENTS

| | | | |
|---|---|---|---|
| 1,043,561 | 11/1912 | Ayer | 219/521 |
| 1,694,725 | 12/1928 | Tabb | 219/521 |
| 2,299,401 | 10/1942 | Melton | 219/521 |
| 2,487,161 | 11/1949 | Melton | 219/521 |
| 2,875,312 | 2/1959 | Norton | 219/521 |
| 2,907,861 | 10/1959 | Melton | 219/521 |
| 2,932,718 | 4/1960 | Marsters | 219/521 |
| 3,109,084 | 10/1963 | Walsh | 219/385 |
| 3,607,134 | 9/1971 | McIntyre | 219/521 |
| 3,683,155 | 8/1972 | Loofbourow | 219/521 |
| 3,940,249 | 2/1976 | McClurg | 23/230 |
| 4,058,370 | 11/1977 | Suovaniemi | 23/259 |
| 4,256,697 | 3/1981 | Baldwin | 422/104 |
| 4,504,733 | 3/1985 | Walsh | 219/521 |
| 4,661,683 | 4/1987 | Glucksman | 219/222 |
| 4,933,146 | 6/1990 | Meyer et al. | 422/63 |
| 4,950,608 | 8/1990 | Kishimoto | 435/290 |

*Primary Examiner*—Teresa J. Walberg

*Attorney, Agent, or Firm*—Gregory D. Williams; George W. Neuner

[57] ABSTRACT

A device for holding multiple sample tubes for automatic temperature control has a block made of heat conductive material, a heating bore extending longitudinally through the block, and multiple sample tube wells. The block has a cross-section wherein a plurality of wells are positioned and arranged in relation to the bore such that the wells are substantially equidistant from the bore, thereby minimizing temperature gradients between the wells.

7 Claims, 2 Drawing Sheets

BLOCK FOR HOLDING MULTIPLE SAMPLE TUBES FOR AUTOMATIC TEMPERATURE CONTROL

FIELD OF THE INVENTION

This invention relates to holding blocks for laboratory use wherein sample tubes or vials are held under regulated temperature control and, more particularly, to a device for holding multiple sample tubes at substantially the same tube to tube temperature as the temperature is automatically controlled in a pre-determined manner.

BACKGROUND OF THE INVENTION

Automated temperature control of a multiple number of sample tubes, or test tubes, is required in many applications such as, for example, biological or biochemical material stability studies, enzyme reactions, enzyme kenetics, DNA/RNA denaturation, freeze-thawing of biochemicals and biologicals, and bacterial transformations, etc.

Typically, the temperature is controlled by immersion in liquid baths or by holding tubes in dry blocks that have heating and cooling elements for regulating and controlling temperature.

The dry block designs generally employ flat metal blocks that are heated and cooled, for example, by a Peltier Element or by pumping heating or cooling fluids through bore holes in the metal blocks, or heated by electrical heating elements.

The typical flat block design utilizes a planar arrangement of wells for sample tubes which are held in a vertical position as illustrated in FIG. 7. This arrangement will lead to an ununiform heating of the sample tubes. Because sample tubes B and C (FIG. 7) are near heaters 1, 2 and 3, they will receive twice the heat load of sample tubes A and D. That differential heat load is maximized when the block material is a poor conductor of heat. Using highly conductive material, the differential heat load can be minimized during certain conditions, for example, steady state and low influx of heat. When the system requires a high rate of change in temperature, a minimum of 250 watts (depending on the weight of the block) is required to induce the desired rate of temperature change. Under these conditions, edge effects appear in the distribution of heat. Certain laboratories have measured temperature variations as much as 5° C. in sample wells or bores (particularly comparing the edge wells to the center wells) during a heating or cooling cycle. See, Resendez-Perez, D. and Barrera-Saldana, H.A., "Thermocycler Temperature Variation Invalidates PCR Results", *Biotechniques*, 9, No. 3, p. 286–292 (September 1990).

Any flat block design that uses more than one heating element can experience further uneven distribution of heating/cooling when using a single control device. This result is due to the different tolerances in the heating or cooling ability (watts/square inch) of the individual heating elements. Using a single control device with the block illustrated in FIG. 7, sample tube B can receive an additional 20 watts of heating power more than sample tube C because the tolerance between different heaters can be high as 4%.

It is desirable to control the temperature of all the sample tubes within 0.5 degrees Celsius or less for static conditions and for dynamic conditions where temperature changes at the rate of up to about 1° C. per second.

Improvements in dry block designs to achieve this goad are still being sought.

SUMMARY OF THE INVENTION

The present invention provides an improved device for automated temperature control of multiple sample tubes or vials which has a significantly decreased temperature gradient between vials for both static and dynamic conditions. The device of the present invention comprises a heat conductive block having a cross-section with a heating element centrally located with respect to a plurality of sample tube wells or bores, the tube wells being arranged in a pattern around the central heating element such that the distance from the heating element to each well is substantially the same. The distance is considered to be substantially the same, for purposes of this invention, if the temperature in any well is not greater than about 0.5° C. from that of any other well when the temperature is static or is not greater than about 1° C. when the temperature changing at a rate less than about 0.5° C. per second.

In a preferred embodiment, a device of the present invention comprises a metal block having a cross-section with at least a portion of the circumference that corresponds to the top surface of the block defined by a spherical or polygonal shape and having wells equally distanced from a single heating and cooling element.

Devices in accord with the present invention will tend to provide a dry block having decreased dimensions for holding the same number of tubes with only one heating element and one cooling element as compared with prior art flat block devices having multiple heating and cooling elements, and will permit the other ends of sample tubes to be spaced further from each other.

DETAILED DESCRIPTION OF THE INVENTION

A device in accord with the present invention to hold sample tubes for automated temperature control comprises a block having a cross-section wherein a plurality of tube wells, preferably three or more, are spatially arranged around a centrally located heating element. The wells permit sample tubes to be held at substantially equal distance from the heating element to minimize the temperature gradient between sample tubes. Preferably, the temperature gradient between any two wells is about 0.5° C. or less at steady state and about 1° C. or less when the temperature of the block is heated or cooled at the rate of about 0.5° C. per second or less.

The heating element is provided by a bore hold extending longitudinally in the block. The bore hole can be fitted with connections for tubing through which hot or cold fluids can be pumped. alternatively, the bore hold can be fitted with a heating or cooling coil, or with an electrical resistance heater, etc.

Devices of the present invention can be designed to hold any number of sample tubes or vials. The dimensions are readily modified by those skilled in the art to accommodate various numbers of vials and vials of various sizes.

One embodiment of a device in accord with the invention is illustrated in FIGS. 1–4. With reference to the drawings, the device 10 comprises an elongated block of a heat conductive material. The block 10 can be made of any of a number of materials such as, for example, copper, aluminum, stainless steel, titanium, heat conductive ceramics, nickel, tin, metal alloys, heat conductive plastics, etc. The preferred material depends upon the specific application. Aluminum blocks are suitable for many applications. The block can be machined, molded, extruded or cast in a suitable dimension by the skilled in the art.

Figure 1:
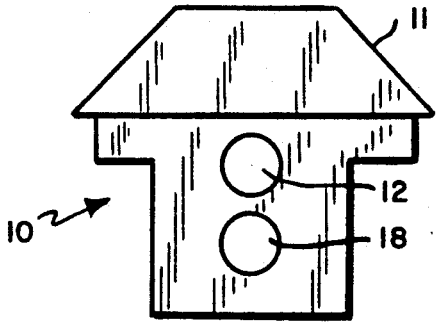
FIG. 1 is an end elevation view of one embodiment of a device in accord with the present invention.
Figure 3:
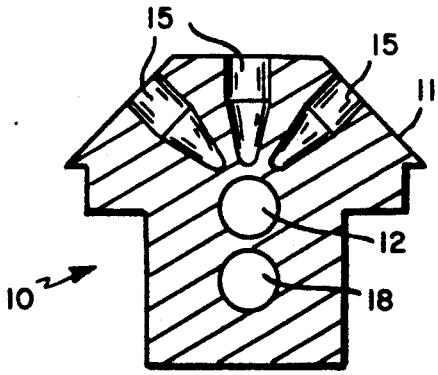
FIG. 3 is a cross-sectional view at line 3—3 of FIG. 2.
Figure 2:
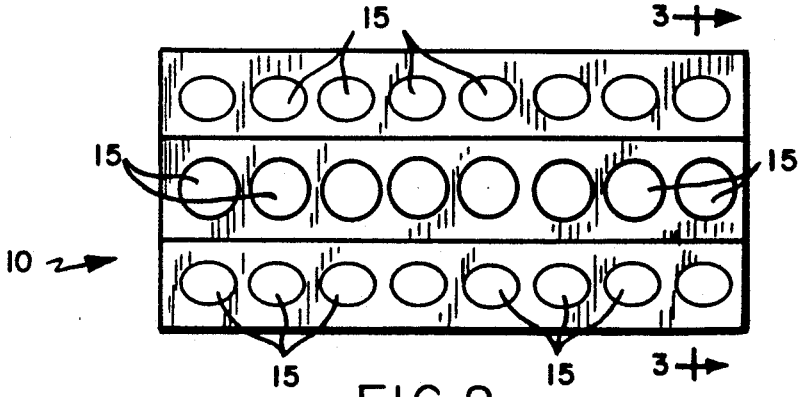
FIG. 2 is a plan view of the device of FIG. 1.
Figure 4:
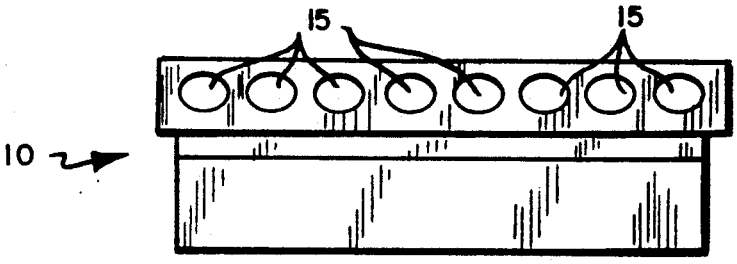
FIG. 4 is an elevation view of the device of FIG. 1.

The embodiment illustrated in FIGS. 1–4 has twenty four sample wells 15 arranged in groups of three around heating bore 12 and cooling bore 18. The top surface 11 of block 10 is hexagonally shaped. One well of each group of three is located in each face of the top surface which is shaped as a hexagon as illustrated (FIG. 3). Other surface shapes can be used. The important thing is the relation between the wells 15 and the heating bore 12 and cooling bore 18. Each of the wells 15 must be substantially the same distance from the bores, thereby providing even heating and cooling.

Figure 5:
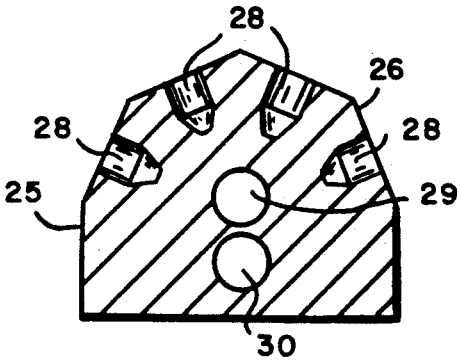
FIG. 5 is an alternative embodiment of a device in accord with the present invention.

FIG. 5 illustrates an alternative embodiment of a device in accord with the present invention having a cross section 25 with the top surface having an octagonal shape 26 wherein four wells 28 are arranged symmetrically around a heating bore 29 and a cooling bore 30.

A test of the device of FIGS. 1–4 showed that the thermal gradient across the block (between wells) was less than one degree Celsius when the temperature of the block 10 was ramped from about 22° C. to 95° C. at a rate of 0.5° C. per second. At steady states the temperature gradient of block 10 was less than 0.5° C.

Figure 6A:
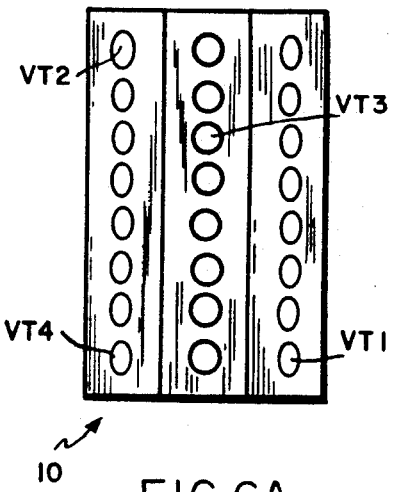
FIG. 6A is a plan view of a device in accord with the present invention illustrating temperature sampling points.
Figure 6B:
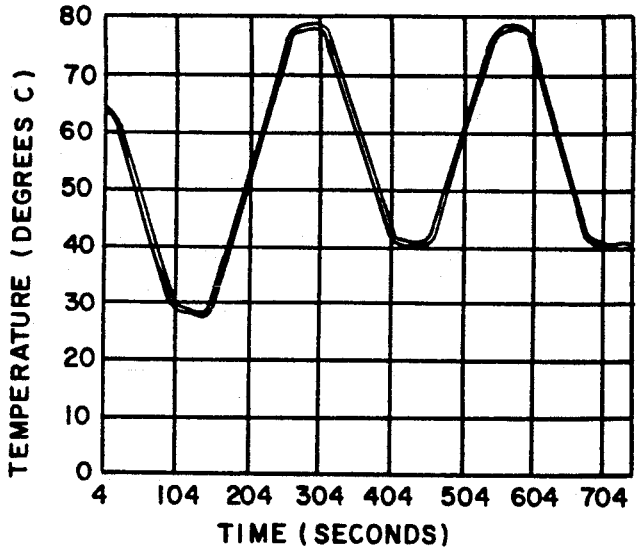
FIG. 6B is a graph illustrating the temperature of the sampling points of FIG. 6A versus time as the temperature of the device is alternately cooled and heated.

FIG. 6A shows the position of four temperature probes VT1–VT4 during a test cycling temperature of block 10. The readings of the four temperature probes are plotted on the graph illustrated in FIG. 6B.

Figure 7:
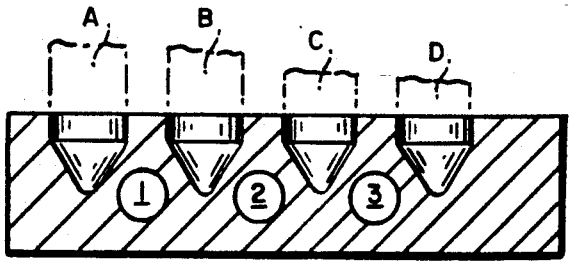
FIG. 7 PRIOR ART
FIG. 7 is a cross section of a typical prior art flat block device.

The device 10 (FIG. 2) in accord with the present invention showed a marked improvement compared to reported temperature gradients of 5° C. with the prior art flat block (FIG. 7).

The invention has been described including the presently preferred embodiments thereof. However, it will be appreciated that those skilled in the art may make modifications within the spirit and scope of the invention. For instance, the top of the block can be maintained flat with the tube wells positioned radially toward a heating bore in the block. Other surface shapes can also be used by those skilled in the art using the teachings of the present invention. Further, other shapes for the heating bore can also be used in place of the circular cross section bore illustrated herein as long as the tube wells are arranged at a substantially equal distance from the bore.

I claim:

1. A device for holding multiple sample tubes for automatic temperature control, said device comprising a block made of heat conductive material, a heating bore extending longitudinally through the block, and multiple sample tube wells, the block having a cross-section wherein a plurality of wells are positioned and arranged in relation to the bore such that the wells are substantially equidistant from the bore and centerlines of the wells converge toward the heating bore, thereby minimizing temperature gradients between the wells.

2. A device for holding multiple sample tubes for automatic temperature control, said device comprising a block made of heat conductive material, a heating bore extending longitudinally through the block, and multiple sample tube wells, the block having a cross-section perpendicular to said bore, wherein a plurality of wells are positioned and arranged in relation to the bore such that the wells are substantially equidistant from the bore, thereby minimizing temperature gradients between the wells, wherein the cross-section has at least three wells spaced substantially equidistant from said heating bore.

3. The device of claim 2 wherein the top surface of the block is of a spherical shape.

4. The device of claim 2 wherein the top surface of the block is of a polygonal shape.

5. The device of claim 2 wherein the cross-section comprises four wells each spaced substantially equidistant from a circular bore.

6. The device of claim 2 wherein the block is made of metal.

7. The device of claim 6 wherein the metal is aluminum.

* * * * *